US011788779B2

(12) United States Patent
Mohanta et al.

(10) Patent No.: US 11,788,779 B2
(45) Date of Patent: Oct. 17, 2023

(54) MULTI-COMPRESSOR OIL EQUALIZATION

(71) Applicant: Carrier Corporation, Palm Beach Gardens, FL (US)

(72) Inventors: Lokanath Mohanta, Liverpool, NY (US); Arindom Joardar, Jamesville, NY (US); Nicolas Fonte, Montluel (FR)

(73) Assignee: Carrier Corporation, Palm Beach Gardens, FL (US)

( * ) Notice: Subject to any disclaimer, the term of this patent is extended or adjusted under 35 U.S.C. 154(b) by 15 days.

(21) Appl. No.: 17/447,474

(22) Filed: Sep. 13, 2021

(65) Prior Publication Data

US 2022/0099341 A1 Mar. 31, 2022

Related U.S. Application Data

(60) Provisional application No. 63/199,727, filed on Jan. 20, 2021, provisional application No. 63/198,033, filed on Sep. 25, 2020.

(51) Int. Cl.

| | |
|---|---|
| ***F25B 31/00*** | (2006.01) |
| ***B01F 25/431*** | (2022.01) |
| ***F25B 1/10*** | (2006.01) |

(52) U.S. Cl.

CPC ..... *F25B 31/002* (2013.01); *B01F 25/4316* (2022.01); *F25B 1/10* (2013.01);

(Continued)

(58) Field of Classification Search

CPC .... F25B 31/002; F25B 1/10; F25B 2400/075; F25B 2500/16; B01F 25/4316; B01F 23/43172

See application file for complete search history.

(56) References Cited

U.S. PATENT DOCUMENTS

| | | | | |
|---|---|---|---|---|
| 4,062,524 A | | 12/1977 | Brauner | |
| 5,265,434 A | * | 11/1993 | Alsenz | G05D 23/20 62/175 |
| 2019/0360727 A1 | | 11/2019 | Christensen | |

FOREIGN PATENT DOCUMENTS

WO WO-2014022198 A1 * 2/2014 ..... F04C 15/0088

OTHER PUBLICATIONS

Pdf attached is original document of foreign reference WO 2014022198 A1 (Year: 2014).*

(Continued)

*Primary Examiner* — Len Tran
*Assistant Examiner* — Kamran Tavakoldavani
(74) *Attorney, Agent, or Firm* — Patricia S. Whitehouse

(57) ABSTRACT

A mixing device and a vapor compression system incorporating a mixing device are provided. The vapor compression system includes a suction line, at least two compressors, and at least one mixing device that is predominantly open (e.g., i.e., include at least a certain percentage, such as seventy percent (70%), of voids/openings). The suction line is used for transferring a working fluid made up of a mixture of a refrigerant and an oil. The suction line includes at least one inlet (e.g., for receiving the working fluid) and at least one outlet (e.g., for distributing the working fluid). The vapor compression system include a first compressor fluidly connected to a first outlet and a second compressor fluidly connected to a second outlet. At least one mixing device is disposed within the suction line (e.g., to increase an internal turbulence of the working fluid).

17 Claims, 9 Drawing Sheets

(52) U.S. Cl.
CPC ... *B01F 25/43172* (2022.01); *F25B 2400/075* (2013.01); *F25B 2500/16* (2013.01)

(56) References Cited

OTHER PUBLICATIONS

Attached pdf is original document of foreign reference WO 2014022198A1 (Year: 2014).*

* cited by examiner

MULTI-COMPRESSOR OIL EQUALIZATION

CROSS REFERENCE TO A RELATED APPLICATION

The application claims the benefit of U.S. Provisional Application Nos. 63/198,033 filed Sep. 25, 2020 and 63/199,727 filed Jan. 20, 2021, the contents of which are hereby incorporated in their entirety.

BACKGROUND

Vapor compression systems (e.g., chillers) commonly include at least one compressor, a condenser, an expansion valve, and an evaporator. Refrigerant circulates through the vapor compression system in order to provide cooling to a medium (e.g., air). The refrigerant exits the compressor(s) through the discharge port(s) at a high pressure and a high enthalpy. The refrigerant then flows through the condenser at a high pressure and rejects heat to an external fluid medium. The refrigerant then flows through the expansion valve, which expands the refrigerant to a low pressure. After expansion, the refrigerant flows through the evaporator and absorbs heat from another medium (e.g., air). The refrigerant then re-enters the compressor(s) through the suction port(s) in the suction line, completing the cycle.

Some vapor compression systems provide for oil to be mixed in with the refrigerant when the refrigerant circulates through the compressor(s) in the vapor compression system. In some instances, the oil is actively managed. For example, the vapor compression system may include an oil separator to remove the oil from the refrigerant as it exits the compressor(s) (e.g., where the removed oil may be circulated back into the compressor(s) by mixing with the refrigerant in the suction line upstream of the compressor(s)). In other instances, the oil is passively managed. For example, the vapor compression system may allow oil to remain mixed with the refrigerant throughout the refrigeration cycle. Regardless of whether the oil is actively or passively managed, it is critical that the compressor(s) receive an adequate amount of oil to keep the compressor(s) lubricated (e.g., to keep the compressor(s) from becoming damaged).

It can become increasingly difficult to ensure adequate lubrication when multiple compressors are incorporated in the vapor compression system. This issue can be especially complex in situations where the refrigerant type is one with a smaller molecule (e.g., such as with R32) and is mixed with a higher viscosity oil with a high oil circulation rate (e.g., up to ten percent (10%)). For example, in these situations one common issue is that the oil may not be evenly disbursed in the refrigerant/oil mixture in the suction line, which may cause an opportunity for one of the compressors to receive a higher proportion of the available oil. This may result in one or more of the compressors in the vapor compression system to not be adequately lubricated, which, as described above, may cause the compressor(s) to become damaged.

Accordingly, there remains a need for a way to prevent or at least mitigate inadequate lubrication of the compressors in a multi-compressor vapor compression system.

BRIEF DESCRIPTION

According to one embodiment, a vapor compression system is provided. The vapor compression system includes a suction line for transferring a working fluid including a mixture of a refrigerant and an oil, the suction line including at least one inlet and at least one outlet. The vapor compression system includes a first compressor and a second compressor in fluid communication with the suction line. The first compressor fluidly connected to a first outlet. The second compressor fluidly connected to a second outlet. The vapor compression system includes at least one mixing device disposed within the suction line. The mixing device configured to increase an internal turbulence of the working fluid. The mixing device including at least seventy percent (70%) void.

In accordance with additional or alternative embodiments, a first mixing device is disposed within a maximum distance upstream of the first outlet.

In accordance with additional or alternative embodiments, the vapor compression system further includes a third compressor in fluid communication with the suction line, the third compressor connected to a third outlet, a second mixing device is disposed within a maximum distance upstream of the second outlet.

In accordance with additional or alternative embodiments, the vapor compression system further includes a fourth compressor in fluid communication with the suction line, the fourth compressor connected to a fourth outlet, a third mixing device is disposed within a maximum distance upstream of the third outlet.

In accordance with additional or alternative embodiments, the refrigerant is in a predominantly vapor phase, and the oil is in a predominantly liquid phase.

In accordance with additional or alternative embodiments, the at least one mixing device includes at least one of: a plate configuration, the plate configuration including a honeycomb shaped cross-sectional area: a vane configuration, the vane configuration including a plurality of equidistantly spaced, circumferentially-extending vanes; and a swirl configuration, the swirl configuration including a plurality of equidistantly spaced, circumferentially-extending members, the plurality of members intersecting at a central axis of the suction line.

According to another aspect of the disclosure, a mixing device for increasing the turbulence of a working fluid including a mixture of a refrigerant and an oil in a suction line is provided. The suction line defining an internal diameter ($D_{SL}$). The mixing device having a plate configuration including a honeycomb shaped cross-sectional area. The honeycomb shaped cross-sectional area defined by a plurality of sidewalls and a plurality of voids. The honeycomb shaped cross-sectional area having at least seventy percent (70%) void.

In accordance with additional or alternative embodiments, each respective void is defined between at least five (5) sidewalls.

In accordance with additional or alternative embodiments, each respective sidewall has a width less than 0.05 ($D_{SL}$).

In accordance with additional or alternative embodiments, each respective void has an internal diameter between 0.3 ($D_{SL}$) and 0.08 ($D_{SL}$).

In accordance with additional or alternative embodiments, the plate configuration includes a first side and a second side defining a plate thickness therebetween, the plurality of sidewalls and the plurality of voids extending from the first side to the second side, the plate thickness being less than 0.05 ($D_{SL}$).

In accordance with additional or alternative embodiments, each respective void includes at least one of: a predominantly uniform internal diameter from the first side to the second side, and a tapered internal diameter from the first side to the second side.

According to another aspect of the disclosure, a mixing device for increasing the turbulence of a working fluid including a mixture of a refrigerant and an oil in a suction line is provided. The suction line defining an internal diameter ($D_{SL}$). The mixing device having a vane configuration including a plurality of equidistanty spaced, circumferentially-extending vanes. Each respective vane having a vane angle of attack, a vane axial length, a vane height, and a vane thickness, wherein at least one of: the vane angle of attack is between 15° and 45°, the vane axial length is 0.05 ($D_{SL}$) and 0.5 ($D_{SL}$), the vane height is between 0.05 ($D_{SL}$) and 0.2 ($D_{SL}$), and the vane thickness is between 0.005 ($D_{SL}$) and 0.02 ($D_{SL}$).

In accordance with additional or alternative embodiments, the vane configuration further includes a circumferential ring, the plurality of equidistantly spaced circumferentially-extending vanes connected to the circumferential ring.

In accordance with additional or alternative embodiments, the circumferential ring includes a ring height and a ring thickness, at least one of the ring height and the ring thickness are between 0.01 ($D_{SL}$) and 0.1 ($D_{SL}$).

In accordance with additional or alternative embodiments, each respective vane includes at least one of: a rectangular configuration and a tapered configuration, the rectangular configuration having a uniform vane height along the vane length, the tapered configuration having a non-uniform vane height along the vane length.

According to another aspect of the disclosure, a mixing device for increasing the turbulence of a working fluid including a mixture of a refrigerant and an oil in a suction line is provided. The suction line defining an internal diameter ($D_{SL}$). The mixing device having a swirl configuration including a plurality of equidistantly spaced, circumferentially-extending members, the plurality of members intersecting at a central axis of the section line. Each respective member including a straight portion and a flap portion. The straight portion configured approximately parallel to the central axis of the suction line. The flap portion including a flap angle of attack, a flap axial length, and a flap thickness, wherein at least one of: the flap angle of attack is between 15° and 45°, the flap axial length is between 0.05 ($D_{SL}$) and 0.5 ($D_{SL}$), and the flap thickness is between 0.005 ($D_{SL}$) and 0.02 ($D_{SL}$).

In accordance with additional or alternative embodiments, the swirl configuration further includes a circumferential ring, the plurality of equidistantly spaced circumferentially-extending members connected to the circumferential ring.

In accordance with additional or alternative embodiments, the straight portion includes a straight axial length between 0.05 ($D_{SL}$) and 0.25 ($D_{SL}$).

In accordance with additional or alternative embodiments, the flap portion includes a split, the split defining a split depth and a split width, the split depth being between 50% and 100% of the flap axial length, the split width being between 0.1 ($D_{SL}$) and 0.5 ($D_{SL}$).

BRIEF DESCRIPTION OF THE DRAWINGS

The subject matter, which is regarded as the disclosure, is particularly pointed out and distinctly claimed in the claims at the conclusion of the specification. The following descriptions of the drawings should not be considered limiting in any way. With reference to the accompanying drawings, like elements are numbered alike:

DETAILED DESCRIPTION

As will be described below, a mixing device and a vapor compression system including at least one mixing device are provided. It should be appreciated that the vapor compression system described herein is a multi-compressor vapor compression system, meaning that at least two compressors are included within the vapor compression system. By incorporating at least one mixing device, the vapor compression system may be capable of preventing or at least mitigating inadequate lubrication of one or more compressors. This inadequate lubrication is commonly caused by the oil (e.g., mixed within the working fluid, which is made up of a mixture of a refrigerant and an oil) being unevenly distributed amongst the compressors. In certain instances, this uneven distribution may be caused by the different materials being in different phases (e.g., the refrigerant may be in a predominantly vapor phase and the oil may be in a predominantly liquid phase when entering the compressors). The mixing device described herein is strategically configured and placed to help prevent or at least mitigate this uneven distribution. Although the mixing device described herein may be viewed as a static mixer it is envisioned that the mixing device may, in certain instances, be a dynamic mixer (e.g., configured as an impeller, etc.). By incorporating a mixing device, the oil may be more evenly distributed throughout the working fluid (e.g., compared to if no mixing device were used), which may help ensure that each compressor within the vapor compression system receives an adequate amount of oil as to remain lubricated. For example, the mixing device described herein may help to ensure that each compressor receive the same, or approximately the same, amount of oil.

Figure 1:
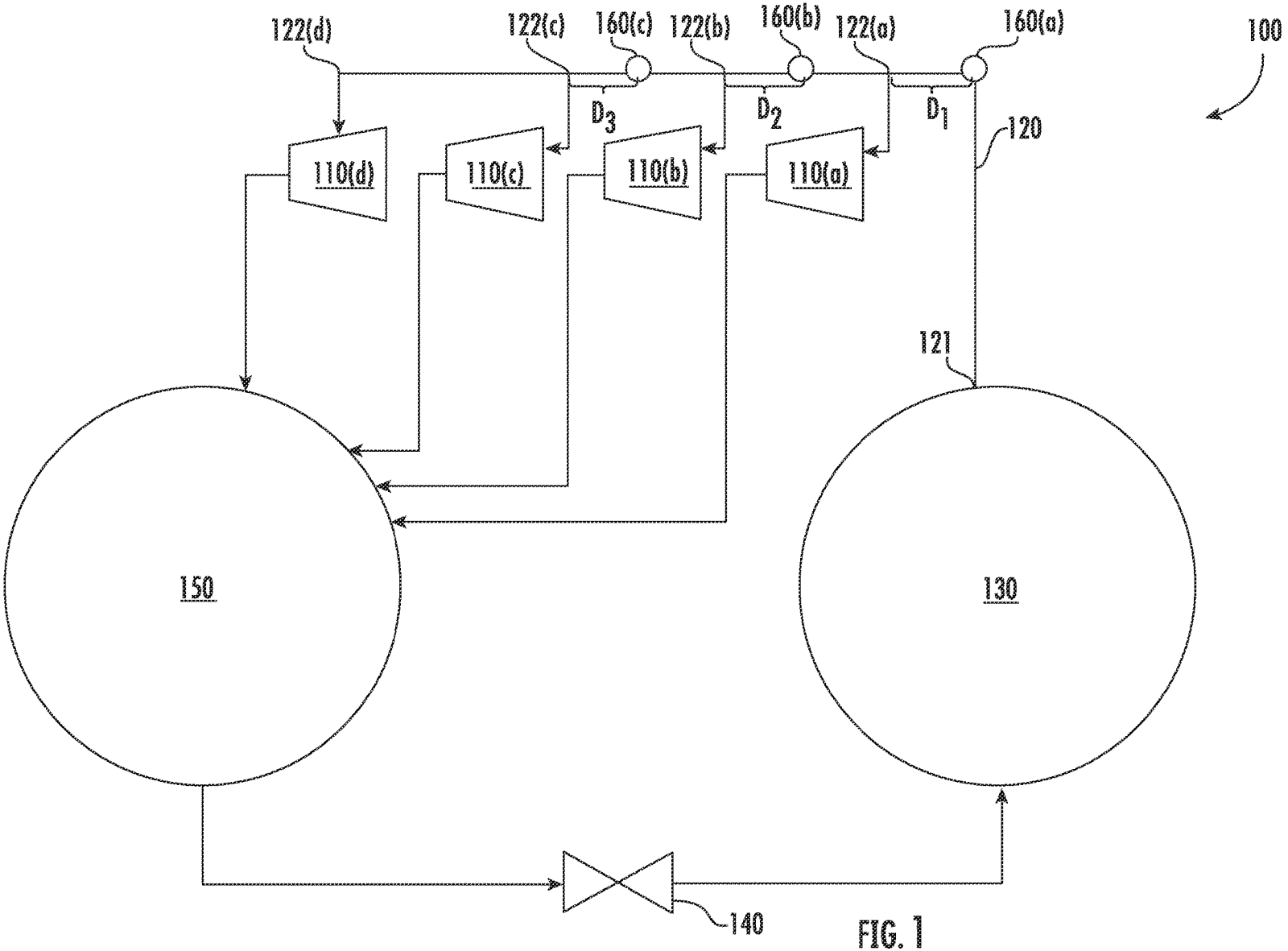
FIG. 1 is a schematic illustration of a vapor compression system including a suction line in fluid communication with multiple compressors, with at least one mixing device disposed in the suction line, in accordance with one aspect of the disclosure.

With reference now to the Figures, a schematic illustration of a vapor compression system 100 including a condenser 150, an expansion valve 140, an evaporator 130, a suction line 120, at least two compressors 110 in fluid communication with the suction line 120, and at least one mixing device 160 disposed in the suction line 120 is shown in FIG. 1. It should be appreciated that the vapor compression system 100 may include any system (e.g., a chiller, etc.) with multiple compressors 110 in fluid communication with a suction line 120 where at least one mixing device 160 is disposed within the suction line 120. It is envisioned that the compressors 110 may be duplicates of the same compressor (e.g., being of the same size and configuration), or may be different (e.g., either sized differently or have different configurations). Regardless of whether the compressors 110 are the duplicates or different from one another, the vapor compression system 100 described herein may be configured to circulate a working fluid (e.g., made up of a mixture of a refrigerant, such as R32, and an oil) through the vapor compression system 100 to provide cooling to a medium (e.g., air, water, glycol, etc.). Although R32 is mentioned, it will be appreciated that other types of refrigerant may be used.

Regardless of the specific type of refrigerant that is in the working fluid, the working fluid will contain at least a certain proportion of oil (e.g., as little as 0.1% of the mixture in some instances) and a certain proportion of refrigerant (e.g., at least 90% of the mixture in some instances). It will be appreciated that the type of oil used may be dependent, at least in part, on the refrigerant selected. This oil may be actively or passively managed by the vapor compression system 100. For example, the oil may either remain within the working fluid (e.g., mixed with the refrigerant) as the working fluid circulates through the vapor compression system 100, or it may be removed (e.g., using an oil separator (not shown)) after the working fluid passes through the compressors 110. Regardless of whether actively or passively managed, this oil may be used to lubricate the compressors 110. As such, it is critical that each compressor 110 receive an adequate supply of oil so as to remain lubricated. It is envisioned that by positioning at least one mixing device 160 in the suction line 120 each of the compressors 110 will receive an adequate supply of oil (e.g., as the mixing device(s) 160 may help ensure the oil is evenly distributed in the working fluid such that each compressor 110 receives the same, or approximately the same, amount of oil).

As shown in FIG. 1, the suction line 120 is used for transferring a working fluid (which is made up of a mixture of a refrigerant and an oil) from the evaporator 130 to the compressors 110. As mentioned above, the working fluid may or may not include the oil in certain locations of the vapor compression system 100 (e.g., if the oil is actively managed the oil may be removed from the working fluid at various locations, and reintroduced to the working fluid before entering the compressors 110). For example, the oil may be remixed into the working fluid in the suction line 120. Regardless of whether the working fluid already includes oil when leaving the evaporator 120, the suction line 120 may include at least one inlet (e.g., the location(s) in which the working fluid (which may or may not include oil) is received from the evaporator 130) and at least one outlet (e.g., the location(s) in which the working fluid is passed to the compressors 110). As shown in FIG. 1, the vapor compression system 100 may include a first compressor 110(*a*) and a second compressor 110(*b*) in fluid communication with the suction line 120. For example, the first compressor 110(*a*) may be fluidly connected to a first outlet 122(*a*) and the second compressor 110(*b*) may be fluidly connected to a second outlet 122(*b*). The mixing device 160, which is disposed in the suction line 120, is configured to increase an internal turbulence of the working fluid (e.g., to ensure that the oil in the working fluid is mixed with the refrigerant).

To ensure that the oil is adequately mixed before a proportion of the working fluid enters the first compressor 110(*a*), the vapor compression system 100 may include a first mixing device 160(*a*) within a maximum distance $D_1$ upstream of the first outlet 122(*a*). It should be appreciated that the maximum distance $D_1$, $D_2$, $D_3$ may be any distance that ensures the oil remains mixed with the refrigerant (e.g., such as one (1) meter away from the respective outlet 122). In certain instances, the maximum distance $D_1$, $D_2$, $D_3$ is set based upon the internal diameter $D_{SL}$ of the suction line 120. For example, the maximum distance $D_1$, $D_2$, $D_3$ may be between two (2) times and twenty (20) times the internal diameter $D_{SL}$ of the suction line 120. For illustrative purposes, if the internal diameter $D_{SL}$ of the suction line 120 is 50 mm (equivalent to approximately 2 inches), then the maximum distance $D_1$, $D_2$, $D_3$ may be between 0.1 meters and 1 meter away from the respective outlet 122. It should be appreciated that the internal diameter $D_{SL}$ of the suction line 120 may be between 12 mm and 130 mm (equivalent to approximately 0.5 inches to 5 inches).

As shown in FIG. 1, the vapor compression system 100 may include a third compressor 110(*c*) in fluid communication with the suction line 120 (e.g., connected to a third outlet 122(*c*)). To ensure that the oil is adequately mixed before a proportion of the working fluid enters the second compressor 110(*b*), the vapor compression system 100 may include a second mixing device 160(*b*) disposed within a maximum distance $D_2$ upstream of the second outlet 122(*b*). It should be appreciated that this maximum distance $D_2$ may be the same length or a different length than the maximum distance $D_1$ between the first outlet 122(*a*) and the first mixing device 160(*a*). As shown in FIG. 1, the vapor compression system 100 may include a fourth compressor 110(*d*) in fluid communication with the suction line 120 (e.g., connected to a third outlet 122(*d*)). To ensure that the oil is adequately mixed before a portion of the working fluid enters the third compressor 110(*c*), the vapor compression system 100 may include a third mixing device 160(*c*) disposed within a maximum distance $D_3$ upstream of the third outlet 122(*c*). It should be appreciated that this maximum distance $D_3$ may be the same length or a different length than the maximum distance $D_1$ between the first outlet 122(*a*) and the first mixing device 160(*a*), or the maximum distance $D_2$ between the second outlet 122(*b*) and the second mixing device 160(*b*). Although shown to include only four compressors 110, it should be appreciated that the vapor compression system 100 may include any number of compressors 110.

Although the vapor compression system 100 described herein is configured to include multiple compressors 110, at times, the vapor compressor system 100 may not utilize all the compressors 110. For example, at times, the vapor compressor system 100 may need to provide for higher cooling capacity (which may require a higher refrigerant compression rate), and at other times, a lower cooling capacity (which may require a lower refrigerant compression rate). To provide continuous efficient supply of the desired amount of compressed refrigerant, the vapor compression system 100 may periodically shut down one or more of the compressors 110 or reduce the operational speed of one or more of the compressors 110. It is envisioned that the vapor compression system 100 may include one or more valves (not shown) to help prevent the flow of working fluid to shutdown compressors 110. The control of the compressors 110 and/or the valves (not shown) may be completed by a controller (not shown), which may be viewed as a programmable logic controller (PLC) or programmable controller, capable of receiving inputs and outputs from one or more sensors, and may include a processor (e.g., a microprocessor) and a memory for storing the programs to control components of the vapor compression system 100 (e.g., the operation of the compressors 110). The memory may include any one or combination of volatile memory elements (e.g., random access memory (RAM), non-volatile memory elements (e.g., ROM, etc.)), and/or have a distributed architecture (e.g., where various components are situated remotely from one another, but can be accessed by the processor).

Regardless of how the compressors 110 are controlled, it is critical that the compressors 110 remain lubricated when in operation As described above, the vapor compression system 100 includes at least one mixing device 160 to help ensure adequate lubrication of the compressors 110. As will be described below, the mixing device(s) 160 may have at least one of: a plate configuration with a honeycomb shaped cross-sectional area (shown in FIGS. 2-4); a vane configuration with a plurality of equidistantly spaced, circumferentially-extending vanes 163 (shown in FIGS. 5-7), and a swirl configuration with a plurality of equidistantly spaced, circumferentially-extending members 165 (shown in FIGS. 8-9). To reduce pressure drop from one side of the mixing device 160 to the other and avoid overly impeding the flow of the working fluid, the cross-sectional area of the mixing device 160 may be predominantly open (i.e., include at least a certain percentage, such as seventy percent (70%), of voids/openings). It should be appreciated that although the vapor compression system 100 may utilize any of the exemplary mixing devices 160 shown in FIGS. 2-9, it is envisioned that any suitable mixing device 160 may be utilized.

Figure 2:
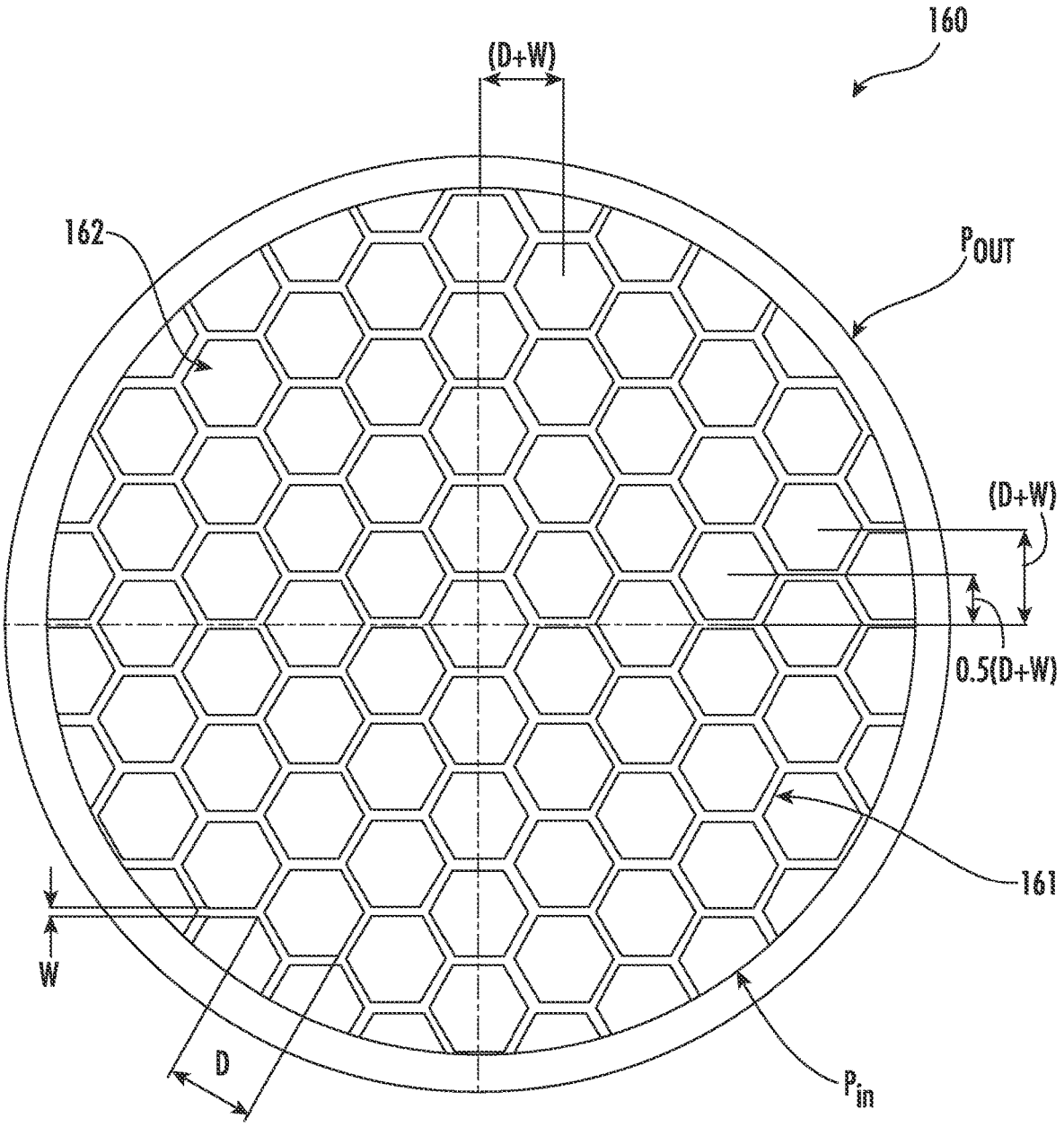
FIG. 2 is a perspective front view of an exemplary mixing device with a plate configuration including a honeycomb shaped cross-sectional area defined by a plurality of sidewalls and a plurality of voids, in accordance with one aspect of the disclosure.
Figure 3:
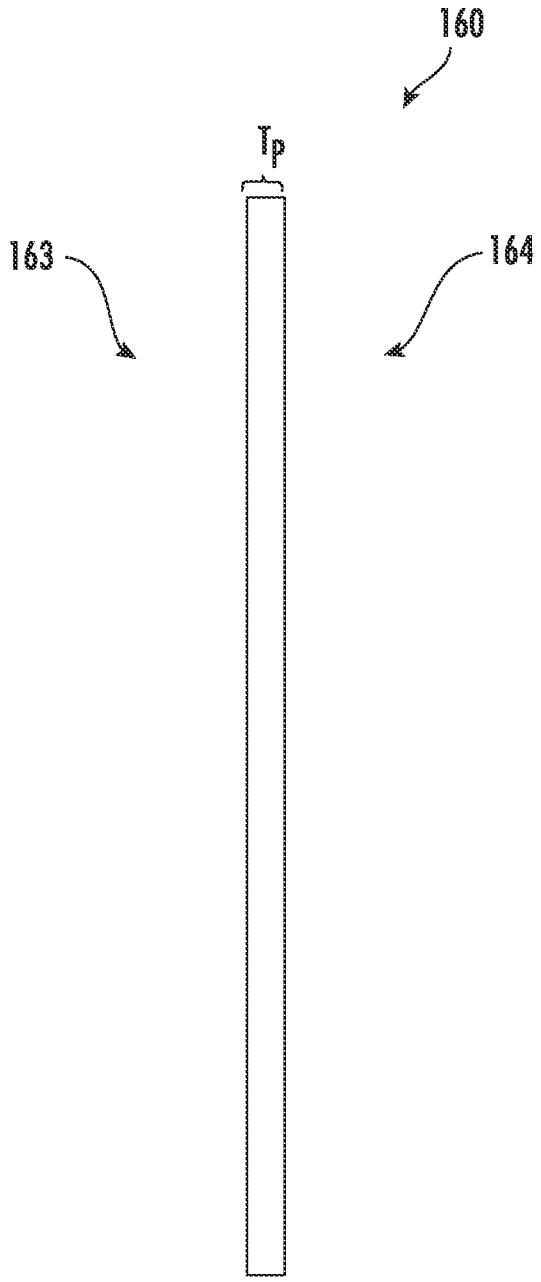
FIG. 3 is a perspective side view of the exemplary mixing device shown in FIG. 2, in accordance with one aspect of the disclosure.
Figure 4:
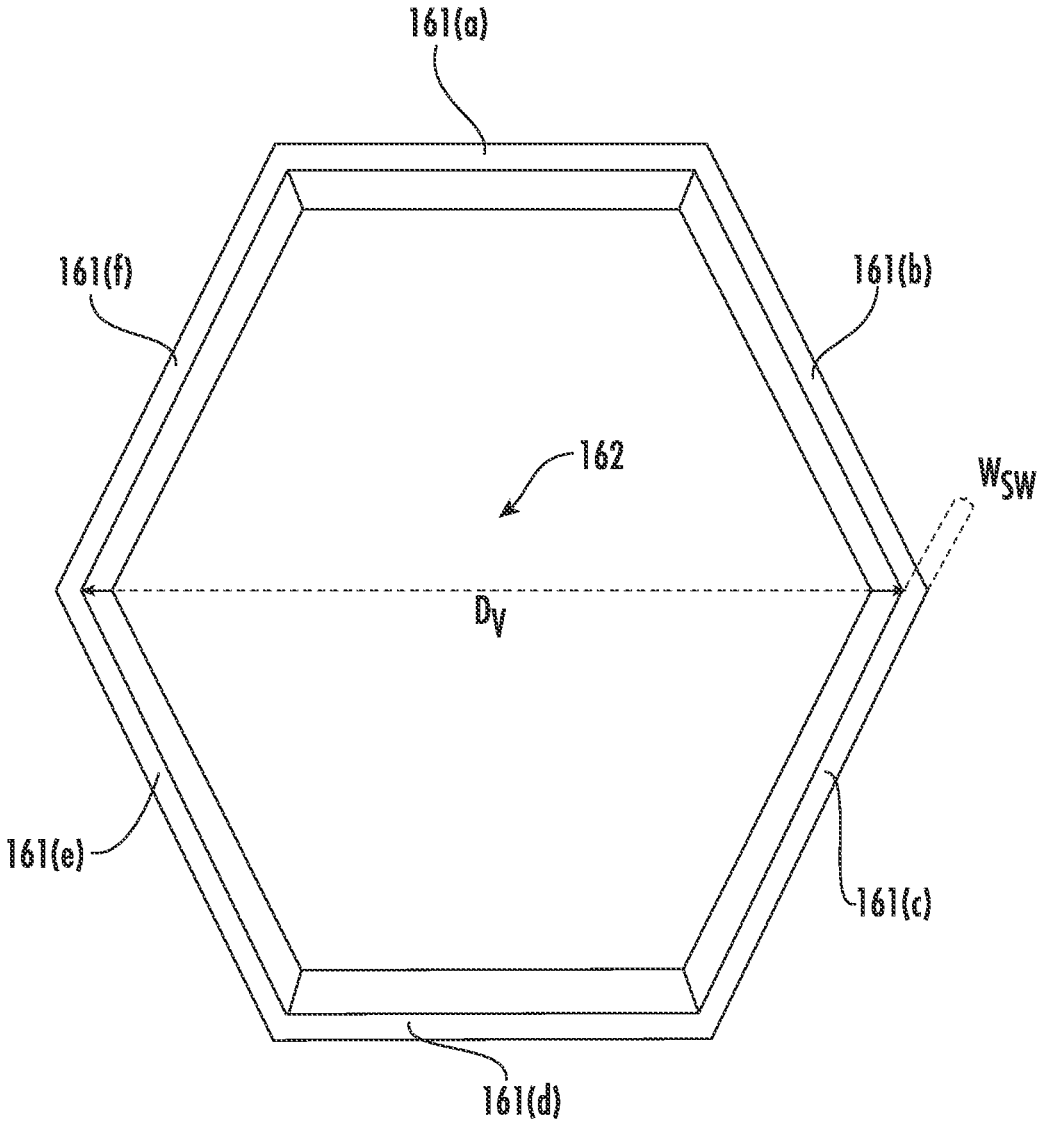
FIG. 4 is a perspective front view of a void defined by a plurality of sidewalls, in accordance with one aspect of the disclosure.

As shown in FIGS. 2 and 3, the mixing device 160 may include a plate configuration with a honeycomb shaped cross-sectional area (e.g., defined by a plurality of sidewalls 161 and a plurality of voids 162). As mentioned above, the cross-sectional area may be made up of at least seventy percent (70%) void 162. It will be appreciated that a void 162 may be defined as the opening/gap between the sidewalls 161. Although shown in FIGS. 2 and 4 to include six (6) sidewalls (e.g., 161(*a*)-161(*f*)) around each void 162, it will be appreciated that any suitable number of sidewalls 161 may be used. For example, each respective void 162 may be defined between at least five (5) sidewalls 162 in certain instances. It is envisioned that each respective sidewall 161 may be configured to maximize the size of the void(s) 162 (e.g., without overly sacrificing the structural integrity of the mixing device 160). It should be appreciated that one or more of the dimensions of the mixing device 160 may be selected based upon the internal diameter $D_{SL}$ of the suction line 120. For example, each respective sidewall 161 may include a defined width $W_{SW}$ (e.g., which may be less than 0.05 ($D_{SL}$) in certain instances) that is selected to maximize the size of the void(s) 162 and/or ensure structural integrity of the mixing device 160. In certain instances, each respective void 162 may have a minimum internal diameter $D_V$, which may be between 0.3 ($D_{SL}$) and 0.08 ($D_{SL}$) in certain instances. It will be appreciated that the specific configuration of the mixing device 160 may depend on the required amount of turbulence needed for the vapor compression system 100.

As shown in FIG. 3, the mixing device(s) 160 may be configured as a plate with a first side 163 and a second side 163, defining a plate thickness $T_P$ (e.g., which may be less than 0.05 ($D_{SL}$) in certain instances) therebetween. FIG. 3 (which is a perspective side view of the mixing device 160) depicts the mixing device 160 shown in FIG. 2 (which is a perspective front view of mixing device 160) rotated ninety degrees (90°). It should be understood that the plurality of sidewalls 161 and the plurality of voids 162 extend from the first side 163 to the second side 163. As shown in FIG. 3, each respective void 162 may have a predominantly uniform internal diameter $D_V$ from the first side 163 to the second side 163. A predominantly uniform internal diameter $D_V$ may be interpreted to mean that the void 162 does not taper from the first side 163 to the second side 163, which may mean that the diameter $D_V$ may be approximately the same (e.g., +/−0.5 mm) on each side 162, 163 of the mixing device 160. Although not shown, it is envisioned that at least one void 162 may taper in certain instances. A void 162 with a tapering internal diameter $D_V$ may be viewed as a void with a different diameter on one side (e.g., the first side 163) than the other (e.g., the second side 164). For example, the diameter $D_V$ on the first side 163 may be 0.6 mm larger than the diameter $D_V$ on the second side 164 when the void 162 is tapering.

Figure 5:
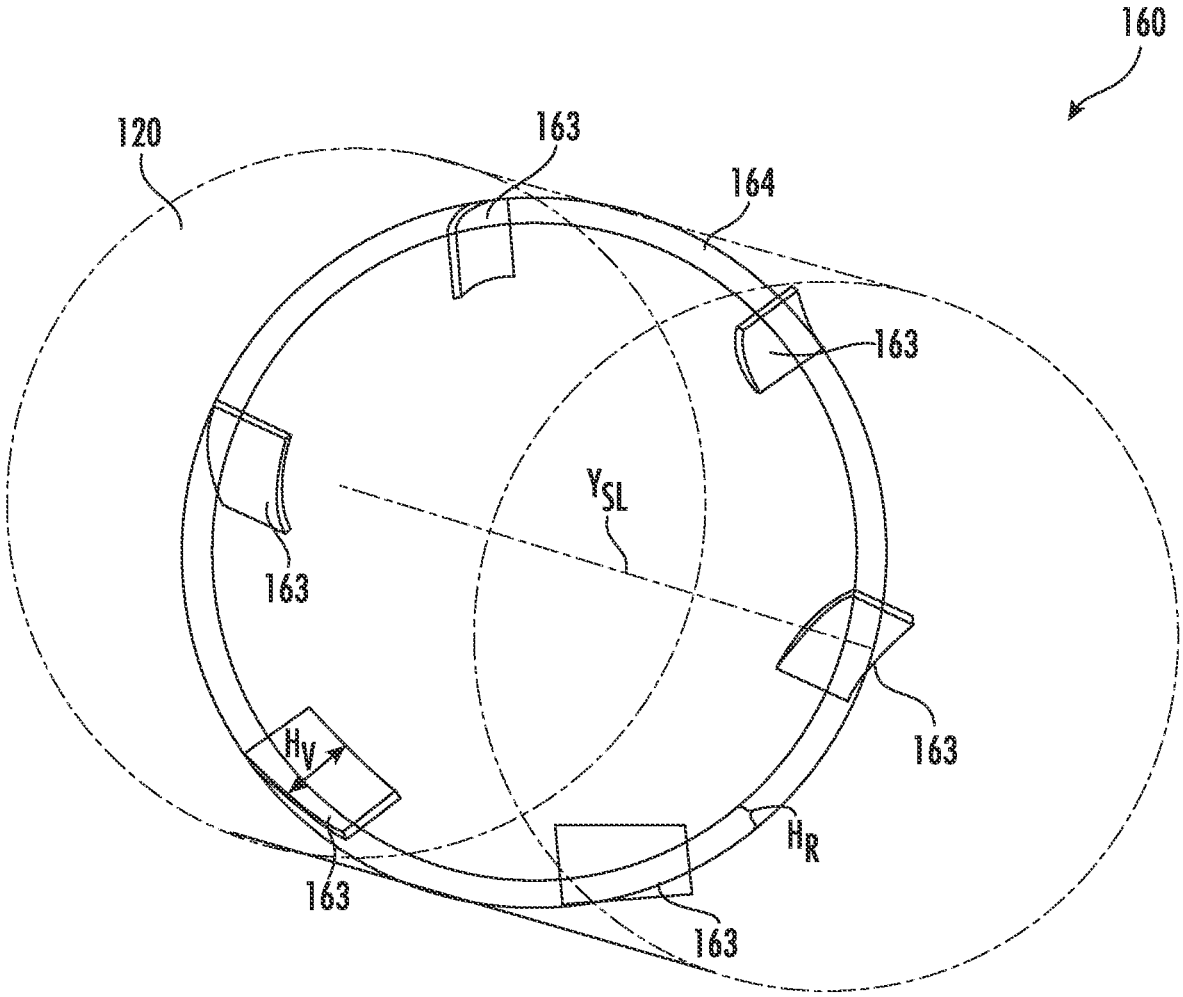
FIG. 5 is a perspective view of an exemplary mixing device with a vane configuration including a plurality of equidistantly spaced, circumferentially-extending vanes connected to a circumferential ring, where each respective vane has a rectangular configuration, in accordance with one aspect of the disclosure.
Figure 6:
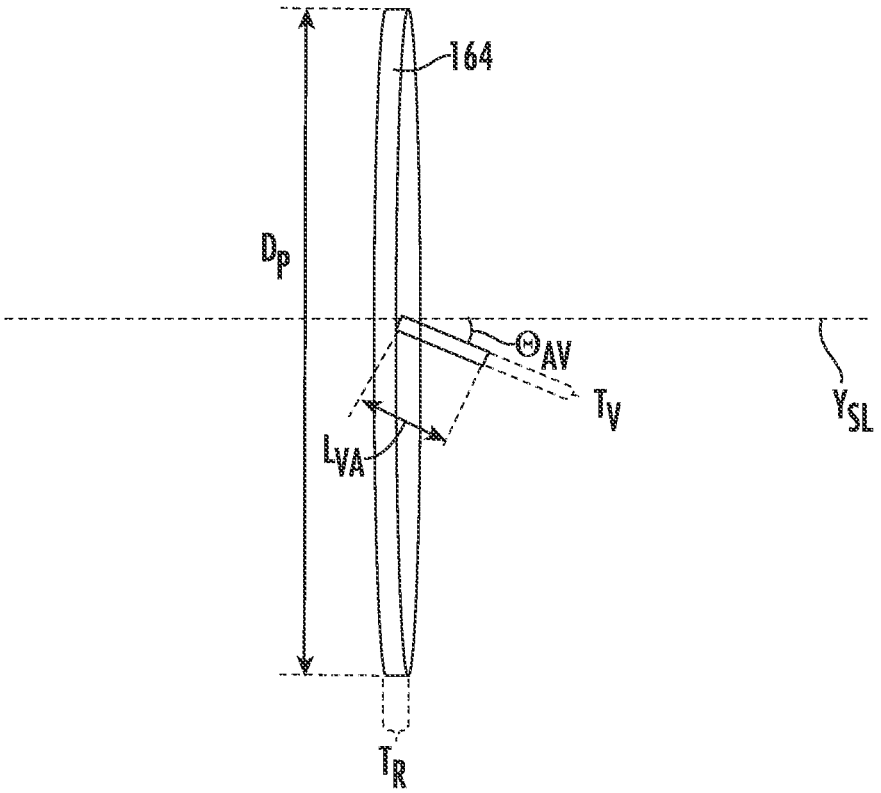
FIG. 6 is a perspective side view of a vane extending from the circumferential ring shown in FIG. 5, in accordance with one aspect of the disclosure.
Figure 7:
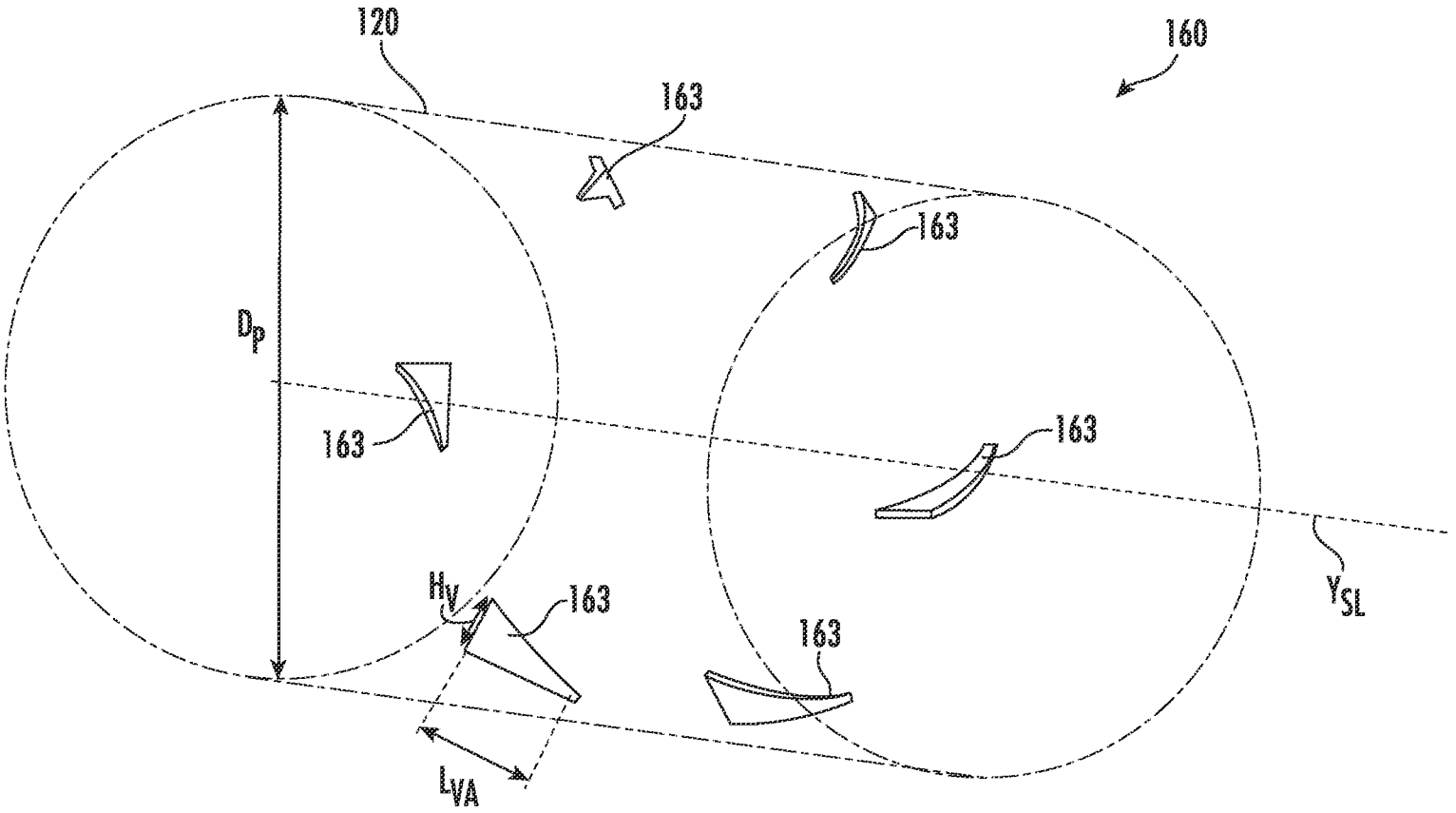
FIG. 7 is a perspective view of the exemplary mixing device shown in FIG. 5, where each respective vane has a tapered configuration, in accordance with one aspect of the disclosure.

As shown in FIGS. 5-7, the mixing device 160 may have a vane configuration in certain instances. The vane configuration includes a plurality of equidistantly spaced, circumferentially-extending vanes 163. It should be appreciated, that although shown to include only six vanes 163 that any number of vanes 163 may be used (e.g., between four (4) and sixteen (16) vanes 163 in certain instances). It is envisioned that the vanes 163 may be directly attached (e.g., through welding, etc.) to the interior surface of the suction line 120 in certain instances. However, as shown in FIG. 5, the vane configuration may include a circumferential ring 164 to which the vanes 163 may be attached (e.g., through welding, etc.). It should be appreciated that the circumferential ring 164, when included, may be attached to the interior surface of the suction line 120 using any suitable connection process (e.g., welding, etc.). Regardless of how connected to the suction line 120, each vane 163 may be viewed to include a vane angle of attack $\Theta_{AV}$ (measured from the central axis $Y_{SL}$ of the suction line 120), a vane axial length $L_{VA}$, a vane height $H_V$, and a vane thickness $T_V$. It should be appreciated that one or more of the above-mentioned dimensions of the vanes 163 may be selected based upon the internal diameter $D_{SL}$ of the suction line 120. To increase the turbulence of the working fluid sufficiently at least one of the following dimensions may apply to each respective vane 163: the vane angle of attack $\Theta_{AV}$ may be between 15° and 45°, the vane axial length $L_{VA}$ may be between 0.05 ($D_{SL}$) and 0.5 ($D_{SL}$), the vane height $H_V$ may be between 0.05 ($D_{SL}$) and 0.2 ($D_{SL}$), and the vane thickness $T_V$ may be between 0.005 ($D_{SL}$) and 0.02 ($D_{SL}$). As shown in FIGS. 5 and 6, the circumferential ring 164 may be viewed to have a ring height $H_R$ and a ring thickness $T_R$. At least one of the ring height $H_R$ and the ring thickness $T_R$ may be between 0.01 ($D_{SL}$) and 0.1 ($D_{SL}$). As mentioned above, it is envisioned that the internal diameter $D_{SL}$ of the suction line 120 may be between 12 mm and 130 mm in certain instances.

Each respective vane 163 may include at least one of: a rectangular configuration (shown in FIG. 5) and a tapered configuration (shown in FIG. 7). The rectangular configuration may be defined by the vane 163 having a uniform vane height $H_V$ along the vane length $L_{VA}$ (meaning that the height $H_V$ is the same at both ends of the vane 163). The tapered configuration may be defined by the vane having a non-uniform vane height $H_V$ along the vane length $L_{VA}$ (meaning that the height $H_V$ is different at each end of the vane 163). For example, when tapered, the vane 163 may have a triangular shape and the vane height $H_V$ may decrease (e.g., either linearly or parabolically) from one end to the other end (as shown in FIG. 7).

Figure 8:
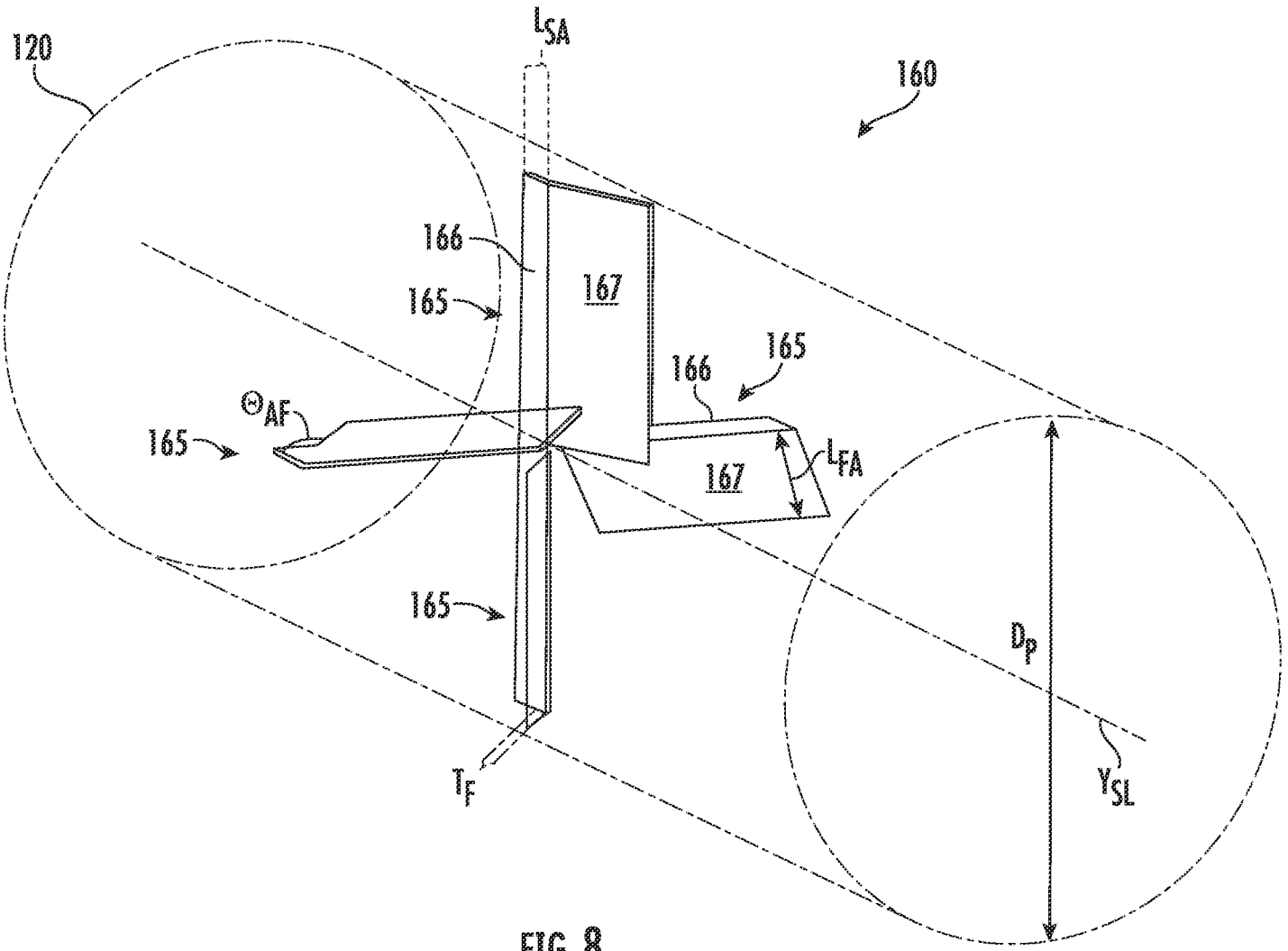
FIG. 8 is a perspective view of an exemplary mixing device with a swirl configuration including a plurality of equidistantly spaced, circumferentially-extending members, the plurality of members intersecting at a central axis of the suction line, in accordance with one aspect of the disclosure.
Figure 9:
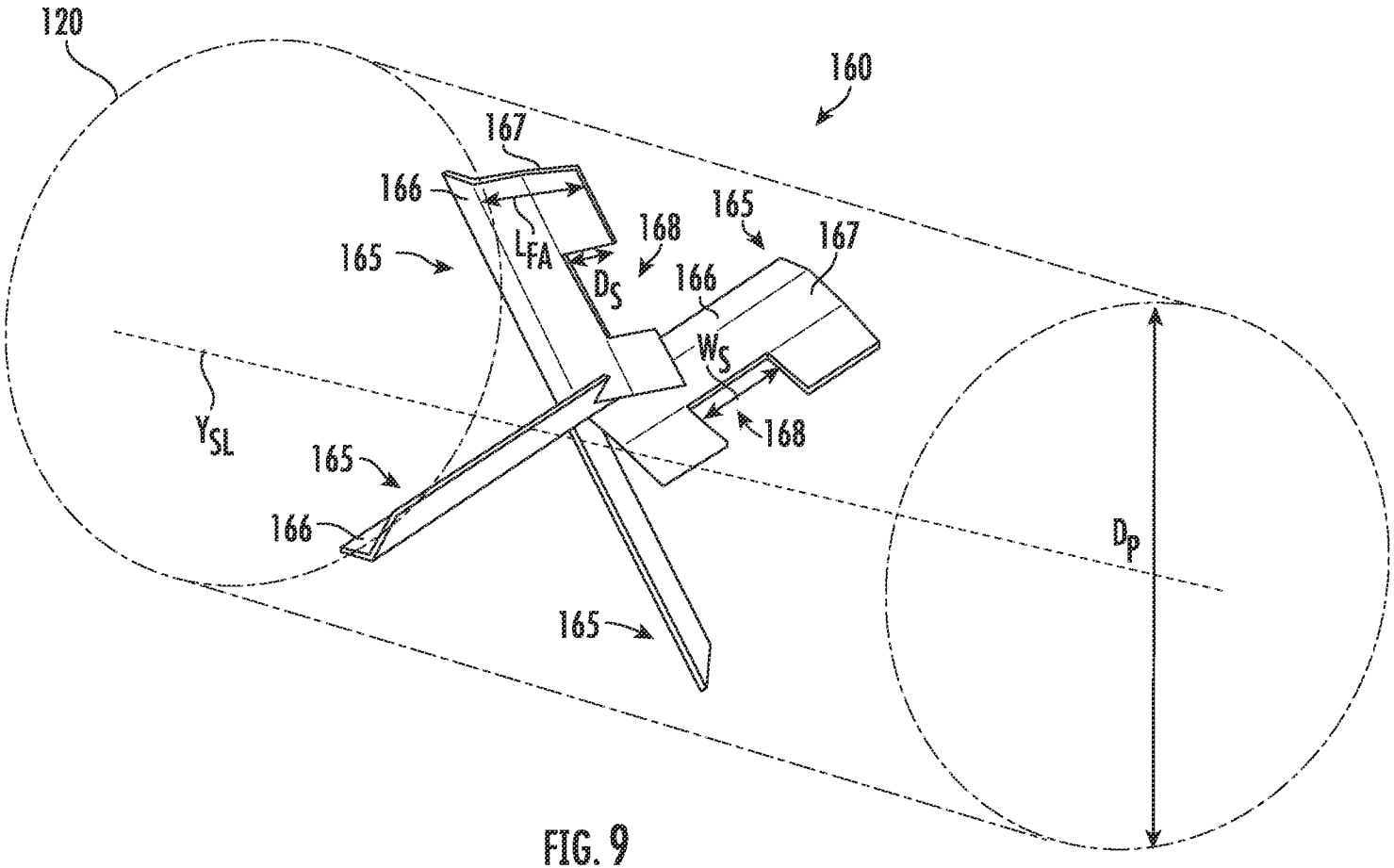
FIG. 9 is a perspective view of the exemplary mixing device shown in FIG. 8 with a split in the flap portion of the members, in accordance with one aspect of the disclosure.

As shown in FIGS. 8-9, the mixing device 160 may have a swirl configuration in certain instances. The swirl configuration includes a plurality of members 165 intersecting at the central axis $Y_{SL}$ of the suction line 120. It should be appreciated, that although shown to include only four members 165 that any number of members 165 may be used (e.g., between four (4) and eight (8) members 165 in certain instances). Each respective member 165 may be viewed to include a straight portion 166 and a flap portion 167. The straight portion 166 may be configured approximately parallel (e.g., +/−5°) of the central axis $Y_{SL}$ of the suction line 120. The flap portion 167 may be viewed to include a flap angle of attack $\Theta_{AF}$, a flap axial length $L_{FA}$, and a flap thickness $T_F$. To increase the turbulence of the working fluid sufficiently at least one of the following dimensions may apply to each respective vane 163: the flap angle of attack $\Theta_{AF}$ may be between 15° and 45°, the flap axial length $L_{FA}$ may be between 0.05 ($D_{SL}$) and 0.5 ($D_{SL}$), and the flap thickness $T_F$ may be between 0.005 ($D_{SL}$) and 0.02 ($D_{SL}$). The straight portion 166 may be viewed to include a straight axial length $L_{SA}$, which may be between 0.05 ($D_{SL}$) and 0.2 ($D_{SL}$) in certain instances. It should be appreciated that the members 165 may be directly attached (e.g., through welding, etc.) to the interior surface of the suction line 120, or to a circumferential ring 164 (similar to the embodiment shown in FIGS. 5-7). Although not shown in FIGS. 8-9, it should be appreciated that the circumferential ring 164, when incorporated into the swirl configuration, have a defined ring height $H_R$ and ring thickness $T_R$, at least one of which may be between 0.01 ($D_{SL}$) and 0.1 ($D_{SL}$).

As shown in FIG. 9, in certain instances the flap portion 167 of at least one member 165 may include a split 168 (viewed as the void/space in the flap portion 167). The split 168 may have a defined split depth $D_S$ and split width $W_S$. The split depth $D_S$ may be between 50% and 100 of the flap axial length $L_{FA}$ in certain instances (meaning that the split 167 may extend all the way through the flap portion 167). The split width $W_S$ may be between 0.1 ($D_{SL}$) and 0.5 ($D_{SL}$) in certain instances. As mentioned throughout, at least one of the above described dimensions of the mixing device 160 may be dependent, at least in part, on the internal diameter $D_{SL}$ of the suction line 120, which may be between 12 mm and 130 mm (equivalent to approximately 0.5 inches to 5 inches) in certain instances. For example, at least one of the vane axial length $L_{VA}$, vane height $H_V$, vane thickness $T_V$, ring height $H_R$, ring thickness $T_R$, flap axial length $L_{FA}$, and flap thickness $T_F$ dimensions may increase as the internal diameter $D_{SL}$ of the suction line 120 increases.

The use of the terms "a" and "and" and "the" and similar referents, in the context of describing the invention, are to be construed to cover both the singular and the plural, unless otherwise indicated herein or cleared contradicted by context. The use of any and all example, or exemplary language (e.g., "such as", "e.g.", "for example", etc.) provided herein is intended merely to better illuminate the invention and does not pose a limitation on the scope of the invention unless otherwise claimed. No language in the specification should be construed as indicating any non-claimed elements as essential to the practice of the invention.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A vapor compression system comprising:

a suction line for transferring a working fluid comprising a mixture of a refrigerant and an oil, the suction line comprising at least one inlet and at least one outlet;

a first compressor and a second compressor in fluid communication with the suction line, the first compressor fluidly connected to a first outlet, the second compressor fluidly connected to a second outlet; and at least one mixing device disposed within the suction line, the mixing device configured to increase an internal turbulence of the working fluid, the mixing device comprising at least seventy percent (70%) void and wherein the at least one mixing device comprises at least one of: a plate configuration, the plate configuration comprising a honeycomb shaped cross-sectional area; a vane configuration, the vane configuration comprising a plurality of equidistantly spaced, circumferentially-extending vanes; and a swirl configuration, the swirl configuration comprising a plurality of equidistantly spaced, circumferentially-extending members, the plurality of members intersecting at a central axis of the suction line.

2. The vapor compression system of claim 1, wherein a first mixing device is disposed within a maximum distance upstream of the first outlet.

3. The vapor compression system of claim 1, further comprising a third compressor in fluid communication with the suction line, the third compressor connected to a third outlet, a second mixing device is disposed within a maximum distance upstream of the second outlet.

4. The vapor compression system of claim 3, further comprising a fourth compressor in fluid communication with the suction line, the fourth compressor connected to a fourth outlet, a third mixing device is disposed within a maximum distance upstream of the third outlet.

5. The vapor compression system of claim 1, wherein the refrigerant comprises a predominantly vapor phase, and the oil comprises a predominantly liquid phase.

6. A mixing device for increasing the turbulence of a working fluid comprising a mixture of a refrigerant and an oil in a suction line, the suction line comprising an internal diameter ($D_{SL}$), the mixing device comprising:

a plate configuration comprising a honeycomb shaped cross-sectional area, the honeycomb shaped cross-sectional area defined by a plurality of sidewalls and a plurality of voids, the honeycomb shaped cross-sectional area comprising at least seventy percent (70%)

void wherein the plate configuration comprises a first side and a second side defining a plate thickness therebetween, the plurality of sidewalls and the plurality of voids extending from the first side to the second side, the plate thickness being less than $0.05(D_{SL})$.

7. The mixing device of claim 6, wherein each respective void is defined between at least five (5) sidewalls.

8. The mixing device of claim 7, wherein each respective sidewall comprises a width less than $0.05(D_{SL})$.

9. The mixing device of claim 6, wherein each respective void comprises an internal diameter between $0.3(D_{SL})$ and $0.08(D_{SL})$.

10. The mixing device of claim 6, wherein each respective void comprises at least one of: a predominantly uniform internal diameter from the first side to the second side, and a tapered internal diameter from the first side to the second side.

11. A mixing device for increasing the turbulence of a working fluid comprising a mixture of a refrigerant and an oil in a suction line, the suction line comprising an internal diameter ($D_{SL}$), the mixing device comprising:

a vane configuration comprising a plurality of equidistantly spaced, circumferentially-extending vanes, each respective vane comprising a vane angle of attack, a vane axial length, a vane height, and a vane thickness, wherein at least one of: the vane angle of attack is between 15° and 45°, the vane axial length is between $0.05(D_{SL})$ and $0.5(D_{SL})$, the vane height is between $0.05(D_{SL})$ and $0.2(D_{SL})$, and the vane thickness is between $0.005(D_{SL})$ and $0.02(D_{SL})$ wherein the vane configuration further comprises a circumferential ring, the plurality of equidistantly spaced circumferentially-extending vanes connected to the circumferential ring.

12. The mixing device of claim 11, wherein the circumferential ring comprises a ring height and a ring thickness, at least one of the ring height and the ring thickness are between $0.01(D_{SL})$ and $0.1(D_{SL})$.

13. The mixing device of claim 11, wherein each respective vane comprises at least one of: a rectangular configuration and a tapered configuration, the rectangular configuration comprising a uniform vane height along the vane length, the tapered configuration comprising a non-uniform vane height along the vane length.

14. A mixing device for increasing the turbulence of a working fluid comprising a mixture of a refrigerant and an oil in a suction line, the suction line comprising an internal diameter ($D_{SL}$), the mixing device comprising:

a swirl configuration comprising a plurality of equidistantly spaced, circumferentially-extending members, the plurality of members intersecting at a central axis of the suction line, each respective member comprising a straight portion and a flap portion, the straight portion configured approximately parallel to the central axis of the suction line, the flap portion comprising a flap angle of attack, a flap axial length, and a flap thickness, wherein at least one of: the flap angle of attack is between 15° and 45°, the flap axial length is between $0.05(D_{SL})$ and $0.5(D_{SL})$, and the flap thickness is between $0.005(D_{SL})$ and $0.02(D_{SL})$.

15. The mixing device of claim 14, wherein the swirl configuration further comprises a circumferential ring, the plurality of equidistantly spaced circumferentially-extending members connected to the circumferential ring.

16. The mixing device of claim 14, wherein the straight portion comprises a straight axial length between $0.05(D_{SL})$ and $0.25(D_{SL})$.

17. The mixing device of claim 14, wherein the flap portion comprises a split, the split comprising a split depth and a split width, the split depth being between 50% and 100% of the flap axial length, the split width being between $0.1(D_{SL})$ and $0.5(D_{SL})$.

* * * * *